US008757614B2

(12) United States Patent
Okamoto et al.

(10) Patent No.: US 8,757,614 B2
(45) Date of Patent: Jun. 24, 2014

(54) SLIDE RAIL, SHEET FEED DEVICE, AND IMAGE FORMING APPARATUS

(71) Applicants: Kouhei Okamoto, Kanagawa (JP); Yasutomo Ide, Kanagawa (JP); Yasuhiro Kuba, Kanagawa (JP); Toshiki Yokoyama, Kanagawa (JP); Tsuyoshi Hashiyada, Kanagawa (JP)

(72) Inventors: Kouhei Okamoto, Kanagawa (JP); Yasutomo Ide, Kanagawa (JP); Yasuhiro Kuba, Kanagawa (JP); Toshiki Yokoyama, Kanagawa (JP); Tsuyoshi Hashiyada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/905,253

(22) Filed: May 30, 2013

(65) Prior Publication Data

US 2013/0334766 A1 Dec. 19, 2013

(30) Foreign Application Priority Data

Jun. 13, 2012 (JP) ..... 2012-133509

(51) Int. Cl.
*B65H 1/00* (2006.01)
*A47B 88/00* (2006.01)

(52) U.S. Cl.
USPC ..... 271/145; 312/334.8; 312/334.7; 312/334.18

(58) Field of Classification Search
USPC ..... 271/145, 262, 264; 312/334.12, 334.7, 312/334.8, 334.16, 334.18, 333, 334.44
See application file for complete search history.

(56) References Cited

U.S. PATENT DOCUMENTS

| | | | | |
|---|---|---|---|---|
| 3,328,106 | A * | 6/1967 | Mullin | 312/334.7 |
| 4,183,596 | A * | 1/1980 | Greene et al. | 312/333 |
| 4,927,216 | A * | 5/1990 | Boda | 312/334.12 |
| 6,585,336 | B2 * | 7/2003 | Munday et al. | 312/334.4 |
| 6,619,772 | B2 * | 9/2003 | Dierbeck | 312/334.13 |
| 6,651,976 | B2 * | 11/2003 | Ohfuchi | 271/145 |
| 7,396,092 | B2 * | 7/2008 | Prentner et al. | 312/334.6 |
| 2001/0035704 | A1 * | 11/2001 | Dierbeck | 312/902 |
| 2001/0054863 | A1 * | 12/2001 | Uchino et al. | 312/334.12 |
| 2002/0005687 | A1 * | 1/2002 | Corona | 312/334.33 |
| 2002/0140331 | A1 * | 10/2002 | Chen et al. | 312/334.46 |
| 2004/0130248 | A1 * | 7/2004 | Chi | 312/334.8 |
| 2006/0043851 | A1 * | 3/2006 | Lee | 312/333 |
| 2006/0157916 | A1 * | 7/2006 | Ahn et al. | 271/145 |
| 2007/0040485 | A1 * | 2/2007 | Tseng et al. | 312/333 |
| 2009/0057975 | A1 * | 3/2009 | Uchida | 270/1.01 |
| 2009/0284115 | A1 * | 11/2009 | Huang et al. | 312/334.44 |
| 2011/0298175 | A1 * | 12/2011 | Muratani | 271/241 |

FOREIGN PATENT DOCUMENTS

| | | |
|---|---|---|
| JP | 62-166753 | 10/1987 |
| JP | 63-153846 | 10/1988 |
| JP | 1-131335 | 9/1989 |
| JP | 2000-287771 | 10/2000 |
| JP | 2001-173305 | 6/2001 |
| JP | 2001-204565 | 7/2001 |
| JP | 2010-120554 | 6/2010 |

* cited by examiner

*Primary Examiner* — Patrick Cicchino
(74) *Attorney, Agent, or Firm* — Cooper & Dunham LLP

(57) ABSTRACT

A slide rail includes a fixed rail, an intermediate rail a movable rail, and a first to fourth rollers. Use of three rails makes a total length of the slide rail shorter to provide a compact slide rail. The fixed rail includes a rectangular-shaped first plate and a pair of first bent parts; the intermediate rail includes a rectangular-shaped second plate opposed to the first plate and a pair of second bent parts; and the movable rail includes a rectangular-shaped third plate opposed to the second plate and a pair of third bent parts. Among the bent parts, the third bent parts are bent in a direction opposite that of the first and second bent parts.

7 Claims, 13 Drawing Sheets

SLIDE RAIL, SHEET FEED DEVICE, AND IMAGE FORMING APPARATUS

CROSS-REFERENCE TO RELATED APPLICATION

The present application claims priority pursuant to 35 U.S.C. §119 from Japanese patent application number 2012-133509, filed on Jun. 13, 2012, the entire disclosure of which is incorporated by reference herein.

BACKGROUND

1. Technical Field

The present invention relates to slide rails for use in a drawer and a paper tray of an apparatus such as a copier, a facsimile machine, or a printer, and further relates to a sheet feed device incorporating the slide rails and paper tray and an image forming apparatus including the sheet feed device.

2. Related Art

Conventionally, slide rails have been configured such that a retainer with a rotary member is assembled between an outer rail and an inner rail. The retainer with a rotary member mounted in the slide rail includes plural ball bearings and the retainer to hold the plural ball bearings so as to be rotatable. The slide rail of the type in which the retainer with a rotary member is mounted between the outer rail and the inner rail is configured such that the inner rail slides relative to the outer rail and the ball bearings in the retainer with a rotary member rotate. Accordingly, the slide rails slidably moves smoothly (see, for example, JP-2000-287771-A, JP-2001-204564-A, and JP-2010-120554-A).

However, the slide rail as disclosed in the above publications required much time to assemble.

As an approach to solve the above problem, a slide rail without a retainer with a rotary member has been proposed (see, for example, JP-2001-173305-A). As illustrated in FIG. 14, a conventional slide rail 101 disclosed in the JP-2001-173305-A includes an outer rail 110; an inner rail 120; a large diameter roller 103; and a pair of small diameter rollers 104. The inner rail 120 is combined with the outer rail 110 so as to be pushed in and pulled out from the outer rail 110. The large diameter roller 103 is mounted at a distal end in the pushing-in direction of the inner rail 120 so as to engage between both inner rims 111 of the outer rail 110. The pair of small rollers 104 is mounted at a proximal end in the pulling-out direction of the outer rail 110 so as to sandwich an inner rim 121 of the inner rail 120. The large diameter roller 103 is mounted to a pinhole 120*a* formed on the inner rail 120 with a pin bearing 122. The small diameter roller 104 is mounted to a pinhole 110*a* formed on the outer rail 110 with a pin bearing 112.

In the conventional art, because the slide rail 101 includes two rails of the outer rail 110 and the inner rail 120, the inner rail 120 ought to slide over the entire length of the outer rail 110. The longer the sliding length of the inner rail 120 is, the longer the entire length of the outer rail 110. As the sliding amount of the inner rail 120 with respect to the outer rail 110 increases, the distance between the small diameter roller 104 serving as a support roller and a leading end of the inner rail 120 in the pulling-out direction also increases. Accordingly, when the inner rail 120 is moved in the pulling-out direction from the outer rail 110, a load exerted on the leading end of the inner rail 120 increases and the inner rail 120 is damaged. Without reinforcing the inner rail 120, the sliding distance of the inner rail 120 is limited.

To cope with the problem, two inner rails 120 can be mounted inside the outer rail 110 such that inner sides of the inner rails 120 face each other to reinforce the inner rail 120. However, the thickness of the slide rail 101 is increased, thereby enlarging the slide rail 101. Therefore, securing the strength of the slide rail 101 without making the slide rail 101 larger has been difficult.

SUMMARY

The present invention is conceived in light of the above background and provides an optimal slide rail collaterally realizing improved strength and a compact size when mounted. The slide rail that the present invention provides includes a fixed rail, an intermediate rail, a movable rail, and a first to fourth rollers. The fixed rail includes a rectangular-shaped first plate and a pair of first bent parts which is continuous with both ends in the width direction of the first plate at one end thereof and is bent in one direction in the depth direction of the first plate so that the other ends approach each other; an intermediate rail includes a rectangular-shaped second plate opposed to the first plate and a pair of second bent parts which is continuous with both ends in the width direction of the second plate at one end thereof and is bent in one direction so that the other ends thereof approach each other, the intermediate rail disposed inside the fixed rail and slidable reciprocally along a longitudinal direction of the first plate, and the second bent parts bending in a same direction as that of the first bent parts; a movable rail includes a rectangular-shaped third plate opposed to the second plate and a pair of third bent parts which is continuous with both ends in the width direction of the third plate at one end thereof and is bent in a direction so that the other ends thereof approach each other, the movable rail disposed inside the intermediate rail and slidable relative to the intermediate rail reciprocally along a longitudinal direction of the second plate both in the pulling-out and the pushing-in directions, and the third bent parts bending in a direction opposite that of the first bent parts; a first roller mounted to the fixed rail at a proximal end in the pulling-out direction thereof and slidable on an outer below surface of the pair of second bent parts; a second roller mounted to the intermediate rail at a distal end in the pushing-in direction thereof and slidable on an inner surface of the pair of first bent parts; a third roller mounted to the intermediate rail at a proximal end in the pulling-out direction thereof and slidable on an inner surface of the pair of third bent parts; and a fourth roller mounted to the movable rail at a distal end in the pushing-in direction thereof and slidable on an inner surface of the pair of second bent parts.

These and other objects, features, and advantages of the present invention will become apparent upon consideration of the following description of the preferred embodiments of the present invention when taken in conjunction with the accompanying drawings.

DETAILED DESCRIPTION

Figures 1A, 1B:
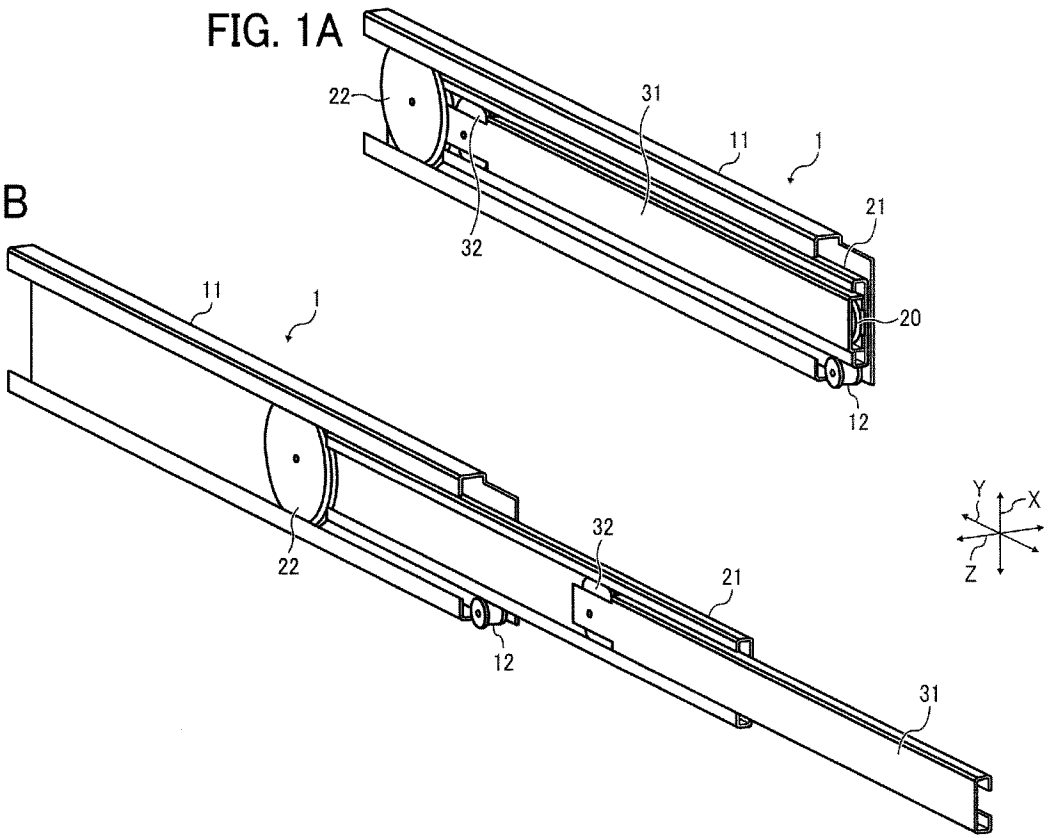
FIGS. 1A and 1B are oblique views of a slide rail according to a first embodiment of the present invention.

Hereinafter, a first embodiment of the present invention will be described with reference to FIGS. 1 to 7. FIGS. 1A and 1B are oblique views of a slide rail 1 according to a first embodiment of the present invention. The slide rail 1 is incorporated in an image forming apparatus that includes an apparatus body and a removable sheet feed device incorporated in the apparatus body. The sheet feed device includes a removable paper tray to contain sheets of paper and a pair of slide rails 1 mounted on both lateral sides of the paper tray.

Figure 2:
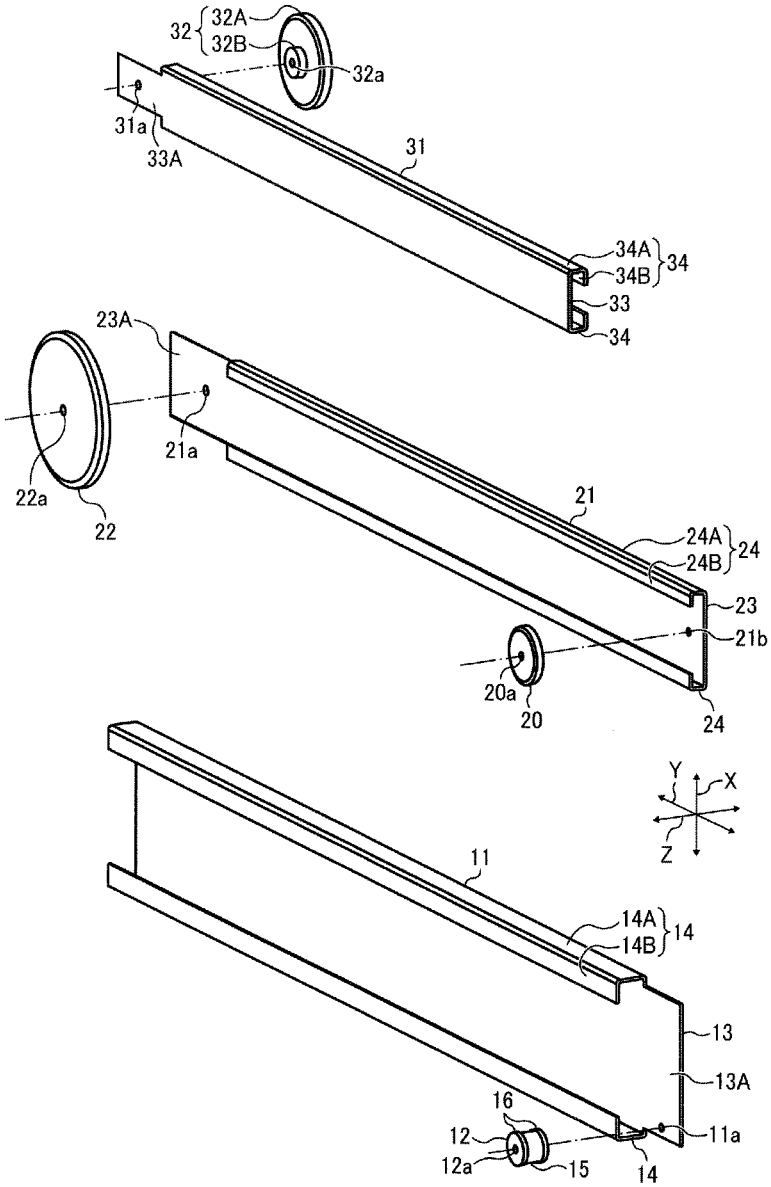
FIG. 2 is an exploded oblique view of the slide rail of FIG. 1.

Referring to FIG. 2, the slide rail 1 includes a fixed rail 11, a first roller 12, an intermediate rail 21, a second roller 22, a third roller 20, a movable rail 31 and a fourth roller 32. The first roller 12 is rotatably mounted on the fixed rail 11. The intermediate rail 21 is slidable reciprocally along a longitudinal direction of the fixed rail 11. The second and third rollers 22 and 20 are movably mounted on the intermediate rail 21. The movable rail 31 is slidable reciprocally along a longitudinal direction of the intermediate rail 21 both in the pulling-out or drawing direction and the pushing-in, storing or mounting direction. The fourth roller 32 is movably mounted on the movable rail 31.

The fixed rail 11 includes a rectangular-shaped first plate 13 and a pair of first bent parts 14 continuous with the long sides of the first plate 13 at one end thereof and bent at another end thereof. The first plate 13 and the pair of first bent parts 14 are integrally formed of a plate which is subject to punching and bending processes.

Herein, an arrow Y in FIGS. 1 and 2 shows a sliding direction of the fixed rail 11, the intermediate rail 21, and the movable rail 31 and a longitudinal direction of the first plate 13, a second plate 23, and a third plate 33 (latter two parts to be described later). Similarly, an arrow X shows a height direction of the fixed rail 11, the intermediate rail 21, and the movable rail 31 and a width direction of the first plate 13, the second plate 23, and the third plate 33. Further, an arrow Z shows a depth direction of the fixed rail 11, the intermediate rail 21, and the movable rail 31 and a depth direction of the first plate 13, the second plate 23, and the third plate 33.

Figure 3:
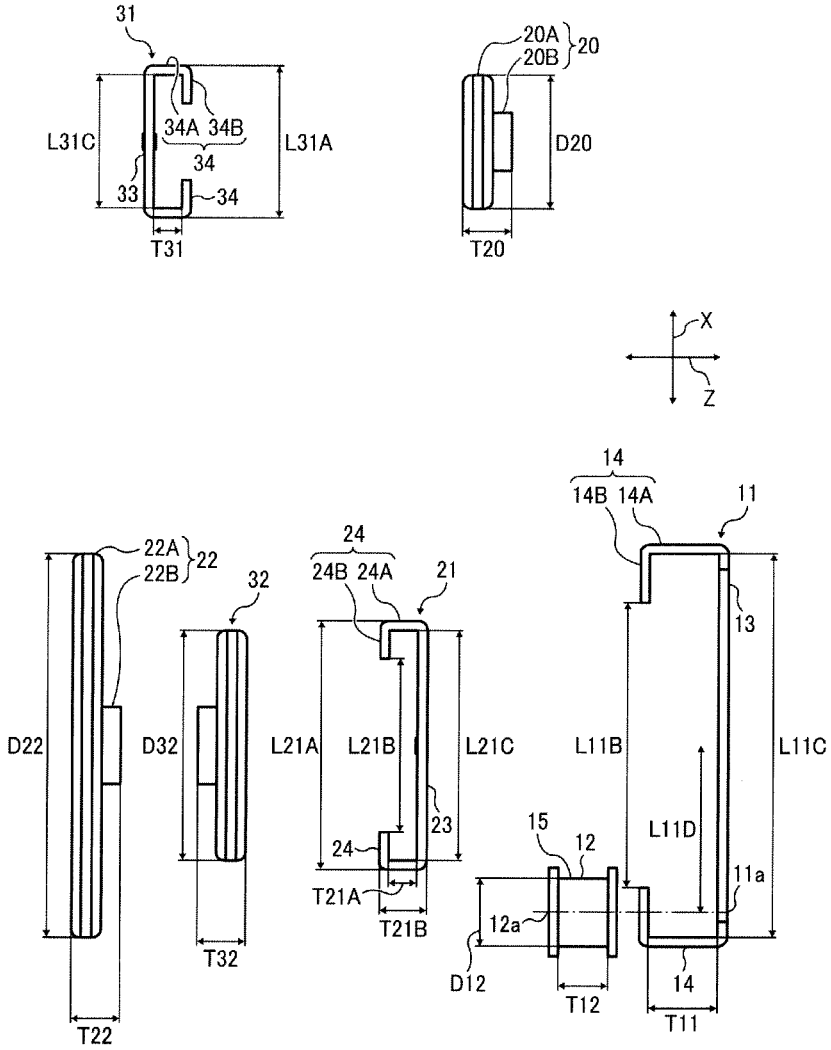
FIG. 3 is a plan view illustrating dimensions of parts constructing the slide rail in FIG. 2 and including a fixed rail, an intermediate rail, a movable rail, a first roller, a second roller, a third roller, and a fourth roller.

As illustrated in FIG. 2, the first plate 13 has a longitudinal size larger than that of the first bent part 14. Accordingly, the first plate 13 includes a portion on which the first bent part 14 is not disposed (which portion is defined as a first extending part 13A) at the proximal edge thereof. The first extending part 13A is a part of the first plate 13 and includes a first through-hole 1*a* disposed at a bottom in the width direction thereof. The first through-hole 11*a* is a through-hole and is used to mount the first roller 12. As illustrated in FIG. 3, the first through-hole 11*a* is positioned apart from a height direction center of the fixed rail 11 by a length L11D being a sum of L21A/2 and D12/2. L21A/2 represents a length from the height direction center of the intermediate rail 21 to an edge thereof. D12/2 represents half the diameter of a roller main part 15 (to be described later) of the first roller 12.

As illustrated in FIGS. 2 and 3, each first bent part 14 includes a first collar plate 14A which is bent perpendicularly from the first plate 13 and a first parallel plate 14B which is bent perpendicularly from the first collar plate 14A and is parallel to the first plate 13. A cross-section of the first bent part 14 is therefore L-shaped. Specifically, the pair of first bent pants 14 is formed by being bent in one direction in the depth direction of the first plate 13.

As illustrated in FIG. 2, the first roller 12 includes the cylindrical roller main part IS, which includes a hole 12*a* in the center thereof, and a pair of large diameter portions 16 having a diameter larger than that of the roller main part 15 and disposed at both ends in an axial direction of the roller main part 15. As illustrated in FIG. 3, in the first roller 12, an axial length T12 of the roller main part 15 is slightly larger than that of a depth T21B of the intermediate rail 21, so that the intermediate rail 21 is slidably placed on the surface of the roller main part IS.

The thus-configured first roller 12 is positioned close to the first plate 13 in the arrow Z direction so as to connect the hole 12*a* with the first through-hole 11*a*. In this state, the hole 12*a* and the first through-hole 11*a* are aligned using fastening member such as a pin, a bolt, a screw, or a rod. The leading end of the pin, the bolt, or the screw is fixed to the first plate 13 at another side of the first plate 13, so that the rust roller 12 is movably mounted to the fixed rail 11.

As illustrated in FIG. 2, the intermediate rail 21 includes a rectangular-shaped second plate 23 and a pair of second bent parts 24 continuous with the long sides of the second plate 23 at one end thereof and bent in a direction so that the other ends approach each other. The second plate 23 and the pair of second bent parts 24 are integrally formed of a plate which is subject to punching and bending processes. As illustrated in FIG. 3, the intermediate rail 21 has a height L21A which is shorter than a length L11B between both edges of the pair of first bent parts 14 and has a depth T21B shorter than a length T11 between the first plate 13 and the first parallel plate 14B of the fixed rail 11.

As illustrated in FIG. 2, the second plate 23 has a longitudinal length which is substantially the same as that of the first plate 13 and longer than that of the second bent part 24. As a result, the second plate 23 includes a portion on which the second bent part 24 is not disposed (which portion is defined as a second extending part 23A) at a distal end thereof. The second extending part 23A is a part of the second plate 23. The second plate 23 includes a second mounting hole 21*a* disposed at a distal end in the pushing-in direction and a center in the width direction thereof. The second mounting hole 21*a* is a through-hole formed in the second extending part 23A of the second plate 23 for mounting the second roller 22. The second plate 23 includes a third mounting hole 21*b* disposed at a center in the width direction and at a proximal edge in the pulling-out direction thereof. The third mounting hole 21*b* is a through-hole formed on the second plate 23 for mounting the third roller 20.

As illustrated in FIGS. 2 and 3, each second bent part 24 includes a second collar plate 24A which is bent perpendicularly from the second plate 23 and a second parallel plate 24B which is bent perpendicularly from the second collar plate 24A and is parallel to the second plate 23. The second bent part 24 has an L-shaped cross-section. Specifically, the pair of second bent parts 24 is formed by being bent in the same direction as that of the first bent part 14 and in one direction in the depth direction of the plates 13, 23 (in the arrow Z direction).

As illustrated in FIGS. 2 and 3, the second roller 22 includes a second circular disc portion 22A and a second small circular disc portion 22B continuous with the second circular disc portion 22A and having a diameter smaller than that of the second circular disc portion 22A.

The second circular disc portion 22A and the second small circular disc portion 22B are formed coaxially and integrally with each other and the second roller 22 includes in its center thereof a pinhole 22*a* through which a fastening member such as a pin, a bolt, or a screw is passed. As illustrated in FIG. 3, a diameter D22 of the second circular disc portion 22A is larger than a height L21A of the intermediate rail 21 and is slightly smaller than a length L11C between the first collar plates 14A of the fixed rail 11. In addition, the second roller 22 has a depth T22 which is smaller than a distance T11 between the first plate 13 and the first parallel plate 14B of the fixed rail 11.

Figure 4:
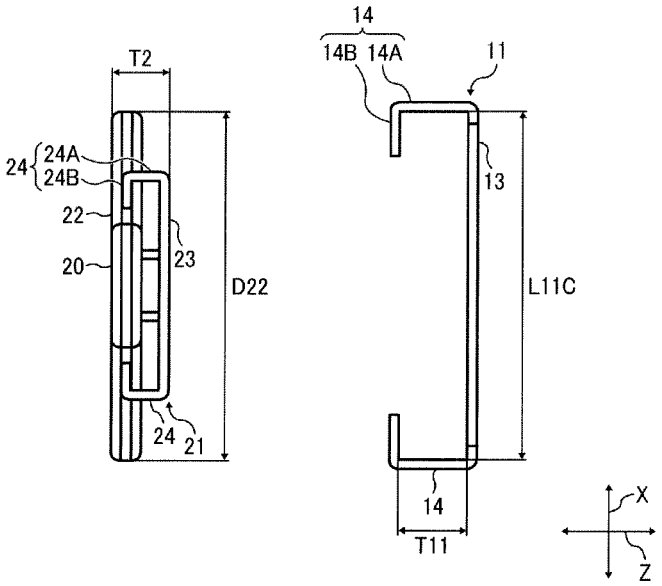
FIG. 4 is a plan view illustrating dimensions of the intermediate rail to which the second and third rollers are mounted.

The second small circular disc portion 22B of the thus-structured second roller 22 is positioned close to one side of the second plate 23 so as to connect the pinhole 22*a* with the second mounting hole 21*a*. In this state, the pinhole 22*a* and the second mounting hole 21*a* are aligned with use of a fastening member such as a pin, a bolt, a screw, or a rod. The leading end of the pin, the bolt, or the screw is fixed to the second plate 23 at the other side of the second plate 23, so that the second roller 22 is movably mounted on the intermediate rail 21. In this case, as illustrated in FIG. 4, the second roller 22 is so mounted as to protrude in one direction from the intermediate rail 21, i.e., in the depth direction as shown by an arrow Z.

As illustrated in FIGS. 2 and 3, the third roller 20 includes a third circular disc portion 20A and a third small circular disc portion 20B continuous with the third circular disc portion 20A and having a diameter smaller than that of the third circular disc portion 20A. The third circular disc portion 20A and the third small circular disc portion 20B are formed coaxially and integrally with each other and the third roller 20 includes in its center thereof a pinhole 20*a* through which a pin, a bolt, or a screw is passed. As illustrated in FIG. 3, the third roller 20 has a depth T20 which is the same as the depth T22 of the second roller 22. Further, a diameter D20 of the third circular disc portion 20A of the third roller 20 is slightly smaller than a distance L31C between third collar plates 34A and the depth T20 is slightly smaller than a distance T31 between the third plate 33 and a third parallel plate 34B of the movable rail 31.

The third small circular disc portion 20B of the thus-structured third roller 20 is positioned close to one side of the second plate 23 so as to connect the pinhole 20*a* with the third mounting hole 21*b*. In this state, the pinhole 20*a* and the third mounting hole 21*b* are aligned with use of a fastening member such as a pin, a bolt, a screw, or a rod. The leading end of the pin, the bolt, or the screw is fixed to the second plate 23 at the other side of the second plate 23, so that the third roller 20 is movably mounted on the intermediate rail 21. In this case, as illustrated in FIG. 4, the third roller 20 is so mounted as to protrude in one direction from the intermediate rail 21, i.e., in the depth direction as shown by the arrow Z. Then, as illustrated in FIG. 4, a depth T2 of the intermediate rail 21 to which the second roller 22 and the third roller 20 are mounted is slightly smaller than a distance T11 between the first plate 13 and the first parallel plate 14B of the fixed rail 1.

When the intermediate rail 21, to which the second roller 22 and the third roller 20 are mounted, is slidably mounted to the fixed rail 11, the intermediate rail 21, the second roller 22 and the third roller 20 are positioned and mounted between the first plate 13 and the first parallel plate 14B of the fixed rail 11. In addition, the total length of the intermediate rail 21 in the sliding direction (the arrow Y direction), to which the second roller 22 and the third roller 20 are mounted, is substantially the same as that of the fixed rail 11.

The movable rail 31 includes the rectangular-shaped third plate 33 and a pair of third bent parts 34 which is continuous with both ends in the width direction of the third plate 33 at one end thereof and is bent in a direction so that the other ends thereof approach each other. The third plate 33 and the pair of third bent parts 34 are integrally formed of a plate which is subject to punching and bending processes. As illustrated in FIG. 3, the movable rail 31 has a height L31A which is shorter than a length L21B between both edges of the pair of second bent parts 24 of the intermediate rail 21. When the movable rail 31 is slidably mounted to the intermediate rail 21 which is mounted to the fixed rail 11, the movable rail 31 is positioned and fitted in between the first plate 13 and the first parallel plate 14B of the fixed rail 11.

As illustrated in FIG. 2, the third plate 33 has a longitudinal length which is substantially the same as that of the pair of second bent parts 24 of the intermediate rail 21 and is longer than the longitudinal length of the third bent parts 34. As a result, the third plate 33 includes a portion on which the third bent parts 34 is not disposed (which portion is defined as a third extending part 33A) at a distal end in the pushing-in direction for mounting. The third extending part 33A is a part of the third plate 33. The third plate 33 includes a fourth mounting hole 31*a* for mounting the fourth roller 32 and disposed at a center in the width direction thereof and at the distal end. The fourth mounting hole 31*a* is a through-hole formed on the third plate 33 (or the third extending part 33A).

As illustrated in FIGS. 2 and 3, each third bent part 34 includes the third collar plate 34A which is bent perpendicularly from the third plate 33 and the third parallel plate 34B which is bent perpendicularly from the third collar plates 34A and is parallel to the third plate 33. As illustrated in FIG. 2, the pair of third bent parts 34 is formed by being bent in the other direction of the third plate 33 being an opposite direction compared to the first bent part 14 and the second bent part 24.

As illustrated in FIG. 2, the fourth roller 32 includes a fourth circular disc portion 32A and a fourth small circular disc portion 32B continuous with the fourth circular disc portion 32A and having a diameter smaller than that of the fourth circular disc portion 32A. The fourth circular disc portion 32A and the fourth small circular disc portion 32B are formed coaxially and integrally with each other and the fourth roller 32 includes, in the center of the fourth circular disc portion 32A and the fourth small circular disc portion 32B, a pinhole 32*a* through which a pin, a bolt, or a screw is passed. As illustrated in FIG. 3, the fourth roller 32 includes the fourth circular disc portion 32A having a diameter D32 which is slightly smaller than a distance L21C between the second collar plates 24A of the intermediate rail 21 and a depth T32 slightly smaller than a distance T21A between the second plate 23 and the second parallel plate 24B of the intermediate rail 21.

The fourth small circular disc portion 32B of the thus-structured fourth roller 32 is positioned close to another side of the third plate 33 so as to connect the pinhole 32*a* with the fourth mounting hole 31*a*. In this state, the pinhole 32*a* and the fourth mounting hole 31*b* are aligned with use of a fastening member such as a pin, a bolt, or a screw, and a leading end of the pin, the bolt, or the screw is fixed to the third plate 33 at one side of the third plate 33, so that the fourth roller 32 is movably mounted on the movable rail 31. In this case, the fourth roller 32 is so mounted as to protrude in one direction from the movable rail 31, i.e., in the depth direction as shown by the arrow Z. A total length in the sliding direction (the arrow Y direction) of the movable rail 31 to which the fourth roller 32 is mounted is the same as that from the proximal end in the pulling-out direction of the intermediate rail 21 to the second roller 22.

Figure 5A:
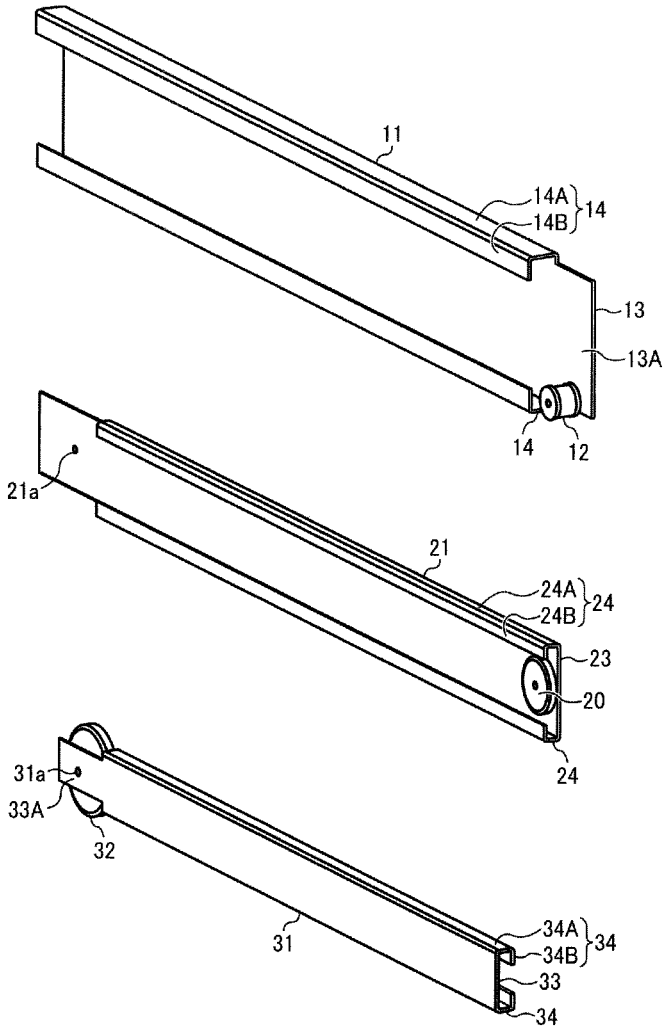
FIGS. 5A and 5B are views illustrating an assembly process of the slide rail as shown in FIG. 1.
Figure 5B:
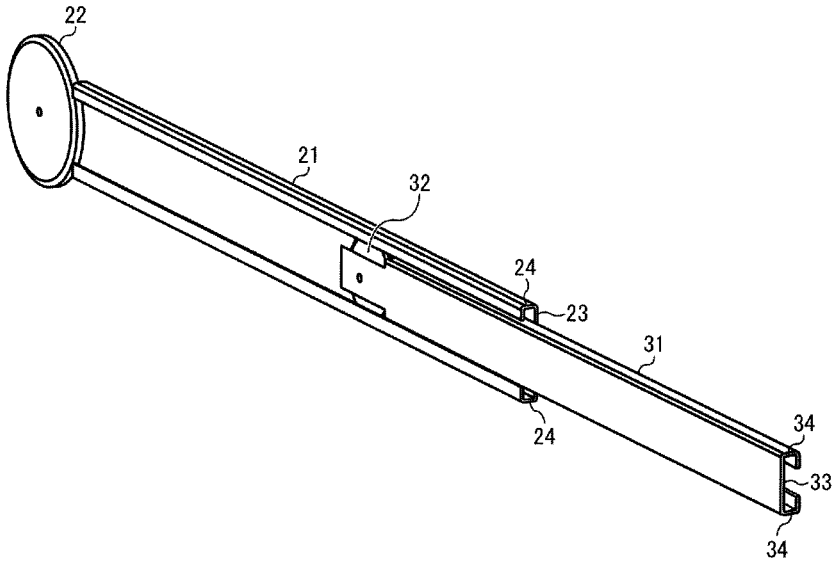

Next, how to mount the slide rail 1 according to the present invention will be described with reference to FIGS. 5A and 5B. First, as illustrated in FIG. 5A, the first roller 12 is mounted to the fixed rail 11, the third roller 20 is mounted to the intermediate rail 21, and the fourth roller 32 is mounted to the movable rail 31. Specifically, the rollers 12, 20, and 32 other than the second roller 22 are respectively mounted to the rails 1, 21, and 31. Then, the drawing-side proximal end of the movable rail 31 is made close to the pushing-in side distal end of the intermediate rail 21 so that the movable rail 31 is inserted into the intermediate rail 21; the third roller 20 is slidably mounted inside the third bent parts 34 of the movable rail 31; and the fourth roller 32 is mounted to slide on an inner wall of the second bent parts 24 of the intermediate rail 21. With this state, as illustrated in FIG. 5B, after the second roller 22 has been mounted to the intermediate rail 21, the drawing-side proximal end of the intermediate rail 21 is made close to the pushing-in distal end of the fixed rail 11 and the intermediate rail 21 into which the movable rail 31 is inserted is inserted into the fixed rail 11. Then, the intermediate rail 21 is mounted on the roller main part 15 (see FIG. 2) of the first roller 12 and the second roller 22 is slidably positioned inside the first bent parts 14 of the fixed rail 11. Thus, the slide rail 1 mounted with the fixed rail 11, the intermediate rail 21 slidably mounted in the fixed rail 11, and the movable rail 31 slidably mounted in the intermediate rail 21 is assembled.

Figure 6A:
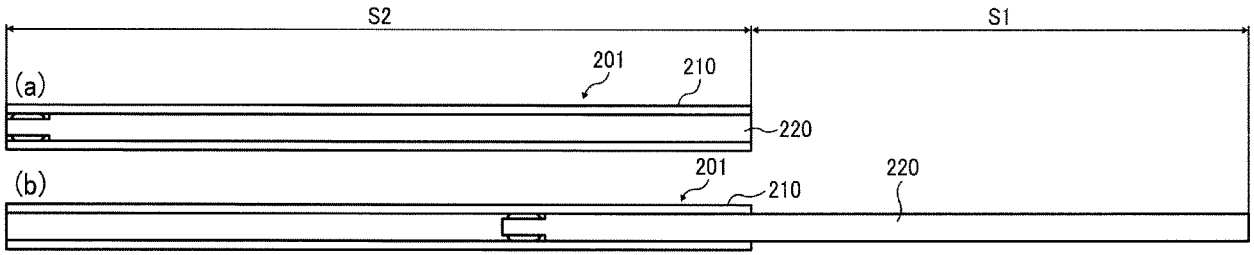
FIGS. 6A and 6B are views for explaining an effect of the embodiment of the present invention.
Figure 6B:
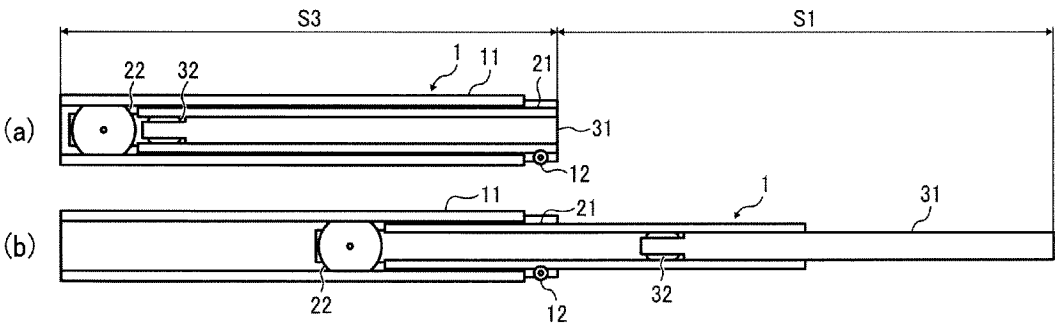

Next, a description will be given of an effect and performance of the embodiment of the present invention. FIGS. 6A and 6B are views for explaining an effect of the present invention, among which FIG. 6A(a) shows a mounted state of a conventional slide rail 201; FIG. 6A(b) shows an extended slate of the conventional slide rail 201; FIG. 6B(a) shows a mounted state of the slide rail 1 according to the present invention; and FIG. 6B(b) shows an extended state of the slide rail 1 according to the present invention. As illustrated in FIGS. 6A and 6B, because the conventional slide rail 201 includes two rails being an outer rail 210 and an inner rail 220 disposed at an inner side of the outer rail and slidably mounted on the outer rail 210, a total length S2 when both rails are stored as the slide rail 201 needs to be longer than the sliding distance S1 of the inner rail 220. In the example as illustrated in FIG. 6A(b), the total length S2 of the slide rail 201 when both rails are stored is 1.5 times the sliding distance S1 of the inner rail 220. In contrast to the conventional example, the slide rail 1 of the present invention includes three rails of the fixed rail 11, the intermediate rail 21, and the movable rail 31, and a total length S3 when three rails are stored is substantially the same as that of the sliding distance S1 of the movable rail 31. More specifically, the slide rail 1 according to the present invention is configured such that the intermediate rail 21 is mounted inside the fixed rail 11 and the movable rail 31 is mounted inside the intermediate rail 21, and therefore, the total length can be shortened more than the conventional slide rail 201 including two rails of the outer rail 210 and the inner rail 220. Further, a load to be applied to the drawing-side distal end of the slide rail 1 which slides supported by the first roller 12 can be distributed to the intermediate rail 21 and the movable rail 31. This structure reinforces the slide rail to provide a strong, compact slide rail. Further, even when the movable rail 31 is maximally drawn, the fixed rail 1 and the intermediate rail 21 partially overlap and the intermediate rail 21 and the movable rail 31 partially overlap, thereby strengthening the entire slide rail.

Figure 7:
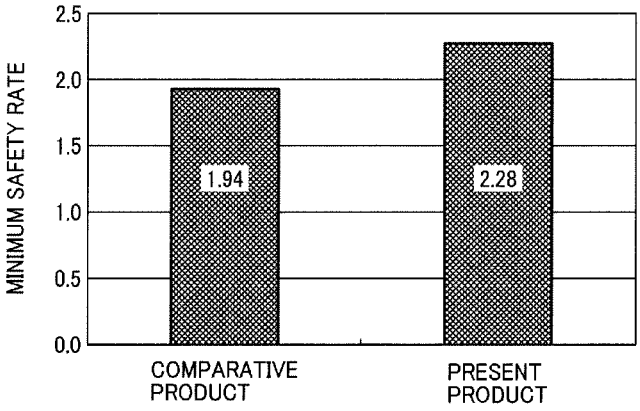
FIG. 7 is a graph showing a result of a strength simulation performed on a product according to the present invention and a comparative product.

FIG. 7 shows a result of strength simulation of the conventional slide rail 201 (comparative product) and the slide rail 1 according to the present invention. In the experiment, the sliding distance S1 is designed to be 300 mm and a load 50N is applied to the drawing-side proximal end of the inner rail 220 and the movable rail 31, respectively. A vertical axis shows a minimum safety rate, calculated by a stress (MPa) applied to each slide rail 1, 201, divided by allowable stress (MPa). The allowable stress is predefined for each material used for the rail. The slide rails 1, 201 each are formed of the same metal material. Conditions for the slide rails 1, 201 are set identical to each other except for a number of rails and a total length of each rail.

FIG. 7 shows an evaluation result. The minimum safety rate as represented by the vertical axis in FIG. 7 means a minimum value of the above-described safety rate. As shown in FIG. 7, the conventional slide rail 201 includes the minimum safety rate of 1.94 and the present slide rail 1 includes the minimum safety rate of 2.28. As a result, it can be seen that the slide rail 1 according to the present embodiment is stronger than the conventional slide rail 201.

Figure 8:
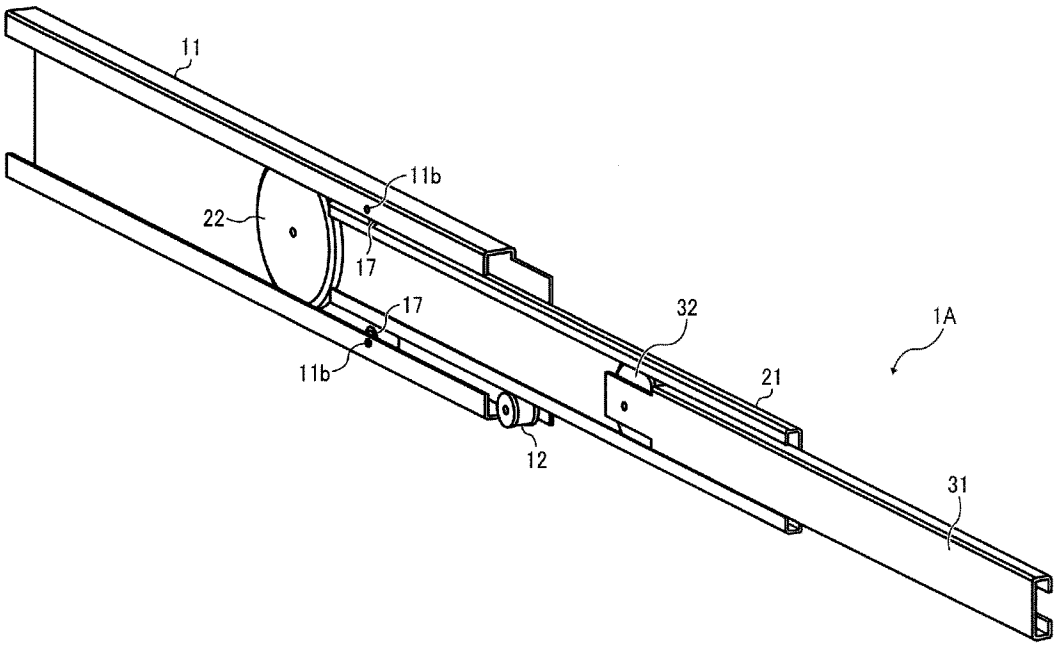
FIG. 8 is an oblique view of a slide rail according to a second embodiment of the present invention.

Hereinafter, a second embodiment of the present invention will be described with reference to FIGS. 8 to 10. The same reference numerals will be applied to a part which is the same as the already explained part in the first embodiment and a redundant explanation thereof will be omitted.

A slide rail 1A according to the second embodiment includes a pair of fifth rollers 17 mounted on the fixed rail 11 closer to the proximal end than the second roller 22 and closer to the distal end than the first roller 12. The pair of fifth rollers 17 sandwiches the pair of second bent parts 24 and is slidable on the external surface of the pair of second bent parts 24. Specifically, the slide rail 1A according to the second embodiment includes the pair of fifth rollers 17 slidably disposed on the fixed rail 1 as illustrated in FIGS. 8 and 9. The pair of fifth rollers 17 disposed closer to the proximal end than the second roller 22 and closer to the distal end than the first roller 12 is disposed at both ends in the depth direction (the arrow X direction) of the fixed rail 1.

Figure 9:
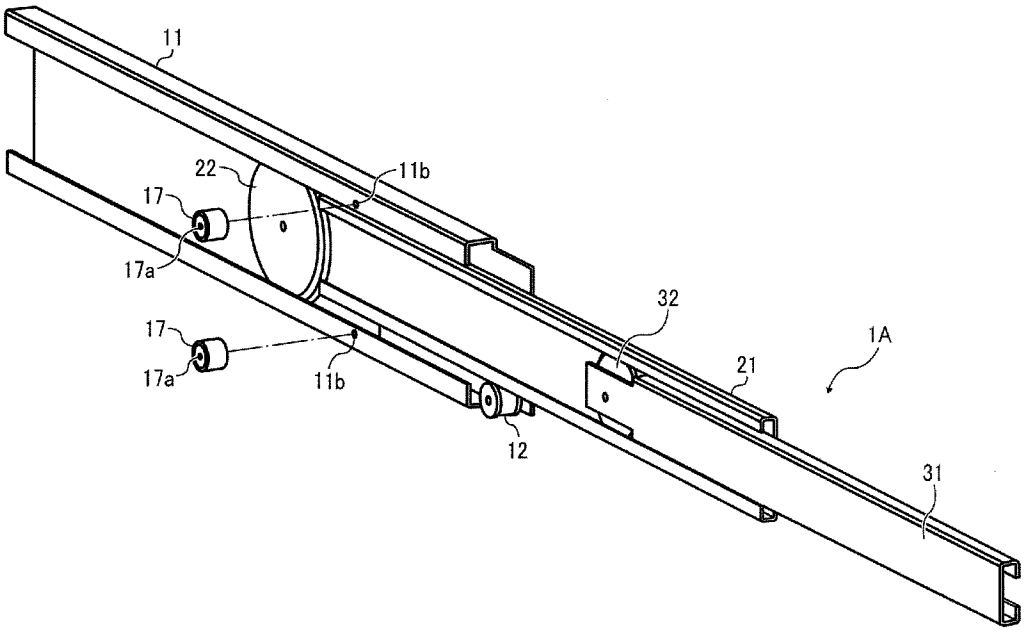
FIG. 9 is an explanatory view illustrating an assembly process of the slide rail of FIG. 8.
Figure 10:
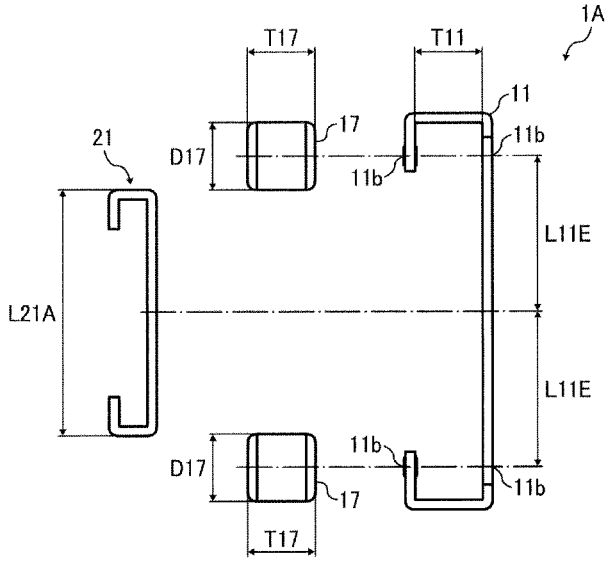
FIG. 10 is an exploded plan view of the slide rail of FIG. 8.

As illustrated in FIG. 9, the fixed rail 11 includes fifth mounting holes 11*b* for mounting the fifth rollers 17. The fifth mounting holes 11*b* are through-holes connecting the first plate 13 with the first parallel plate 14B of the first bent part 14. As illustrated in FIG. 10, a distance L11E from a center of the height of the fixed rail 11 to the fifth mounting hole 11*b* is configured to be slightly larger than the sum of L21A/2 and D17/2. L21A/2 represents a length from the height direction center of the intermediate rail 21 to an edge thereof. D17/2 represents half the diameter D17 of the fifth roller 17.

Each of the fifth roller 17 is cylindrically formed and includes a hole 17*a* in its center thereof. An axial length T17 of the fifth roller 17 is slightly shorter than the distance T11 between the first plate 13 and the first parallel plate 14B of the fixed rail 11.

The thus-configured fifth rollers 17 are mounted to the fixed rail 11 in the manner similar to that of the first roller 12. Then, when the pair of fifth rollers 17 is mounted to the fixed rail 11, the pair of fifth rollers 17 sandwiches and holds the intermediate rail 21 and each roller 17 slidably contacts the external surface of the second bent part 24 of the intermediate rail 21.

According to the second embodiment, the pair of fifth rollers 17 sandwiches the pair of second bent parts 24 each other and each roller is so disposed as to slide on the external surface of the pair of second bent pasts 24, so that the pair of fifth rollers 17 can securely hold the intermediate rail 21. With this structure, the intermediate rail 21 can be securely held by the fixed rail 11 and the pair of fifth rollers 17 is positioned between the first roller 12 and the second roller 22, so that the load applied to the first roller 12 and the second roller 22 is distributed to each of the fifth rollers 17, thereby improving the slidability of the intermediate rail 21 and the load-bearing capacity of the entire slide rail.

Figure 11:
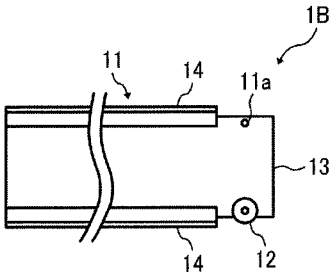
FIG. 11 is an oblique view of a slide rail according to a third embodiment of the present invention.

Hereinafter, a third embodiment of the present invention will be described with reference to FIG. 11. The same reference numerals will be applied to a part which is the same as the already explained part in the first embodiment and a redundant explanation thereof will be omitted.

A slide rail 1B of the third embodiment includes the first roller 12 with the cylindrical roller main part 15. The first roller 12 includes the hole 12*a* in its center thereof. The first roller 12 is mounted to the fixed rail 11 by a pin, a bolt, a screw, or a rod passing through the first through-hole 11*a* (being the through-hole) and the hole 12*a* in a state in which the first through-hole 11*a* and the hole 12*a* are aligned with each other, and the first through-hole 11*a* is disposed in a pair at both edges in the width direction of the first plate 13. Specifically, the slide rail 1B of the third embodiment includes the first through-holes 11*a* for use to mount the first roller 12 in a pair at both edges in the height direction (the arrow X direction) of the fixed rail 11. The first roller 12 may be disposed at both of the pair of first through-holes 11*a*.

According to the third embodiment, because the first through-hole 11*a* (the through-hole) to mount the first roller 12 is disposed in a pair at both widthwise edges of the first plate 13 and at both heightwise edges of the fixed rail 11 (in the arrow X direction), when the slide rail 1 is used in a pair in combination, the fixed rail 11 for the right side and the fixed rail 11 for the left side are arranged symmetrically. Accordingly, because the right-side fixed rail 11 and the left-side fixed rail 11 are manufactured using a same metal mold, the manufacturing cost may be reduced.

Hereinafter, a fourth embodiment of the present invention will be described with reference to FIGS. 12 and 13. The same reference numeral will be applied to a part which is the same as the already explained part in the first embodiment and a redundant explanation thereof will be omitted.

Figure 12A:
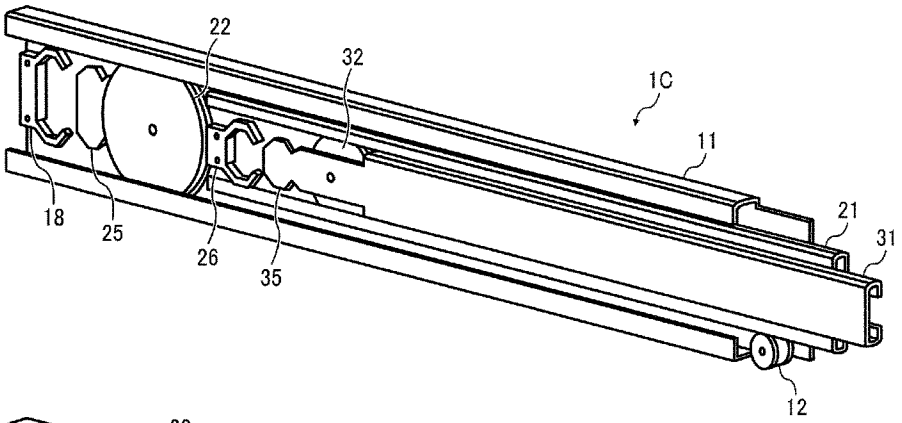
FIGS. 12A and 12B each are oblique views of a slide rail according to a fourth embodiment of the present invention.
Figure 12B:
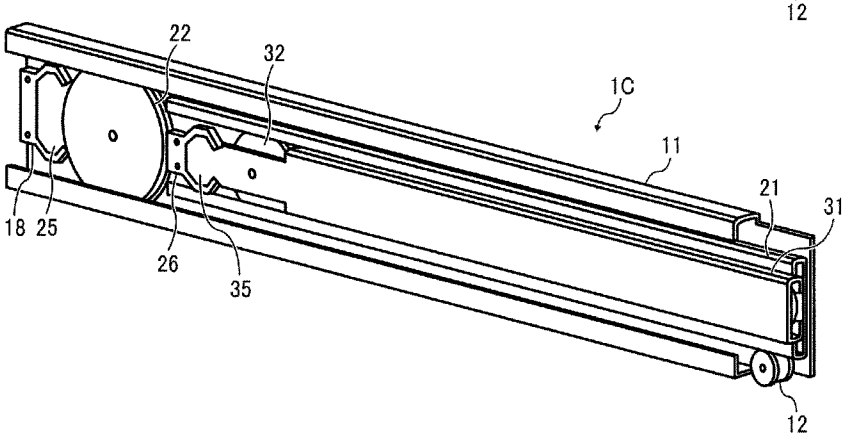

A slide rail 1C of the fourth embodiment includes a first engaging member 18 disposed on the fixed rail 11 and a first engaged member 25 disposed on the intermediate rail 21. The first engaged member 25 extends from the second plate 23 in the pushing-in direction, disposed at the distal end of the second roller 22, and detachably engaged by the first engaging member 18. Further, a second engaging member 26 is disposed on the intermediate rail 21 closer to the pulling-out proximal side than the second roller 22. A second engaged member 35 disposed on the movable rail 31 is extending from the third plate 33 toward the pushing-in side, is positioned closer to the pushing-in distal end than the fourth miler 32, and is detachably engaged by the second engaging member 26. Specifically, the slide rail 1C according to the fourth embodiment includes, as illustrated in FIGS. 12A and 12B, the first engaging member 18 mounted on the fixed rail 11, the first engaged member 25 mounted on the intermediate rail 21 and detachably engaged by the first engaging member 18, the second engaging member 26 disposed on the intermediate rail 21 at a position closer to the pulling-out proximal end than the first engaged member 25, and the second engaged member 35 disposed on the movable rail 31 and slidably engaged by the second engaging member 26.

Figure 13A:
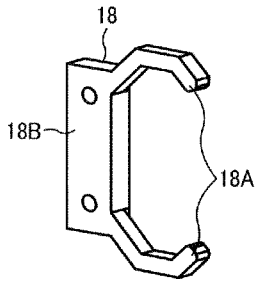
FIG. 13A shows a first joint included in the slide rail of FIGS. 12A and 12B and FIG. 13B shows a second joint included in the slide rail of FIGS. 12*a* and 12B.

As illustrated in FIG. 13, the first engaging member 18 includes a pair of arm members 18A, and a joint member 18B to connect the pair of arm members 18A, three members of which are integrally formed. The pair of arm members 18A is configured to extend in a direction separating from each other and to get back in a direction approaching each other. The first engaging member 18 is fixed to one side of the first plate 13 at a distal end in the in the pushing-in direction.

The first engaged member 25 is disposed at a position further extended from the second extending part 23A of the second plate 23. Specifically, the first engaged member 25 is disposed in the pushing-in side more in the back than the second roller 22. The first engaged member 25 has a tapered, wavy shape.

Figure 13B:
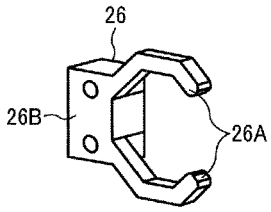
Figure 14:
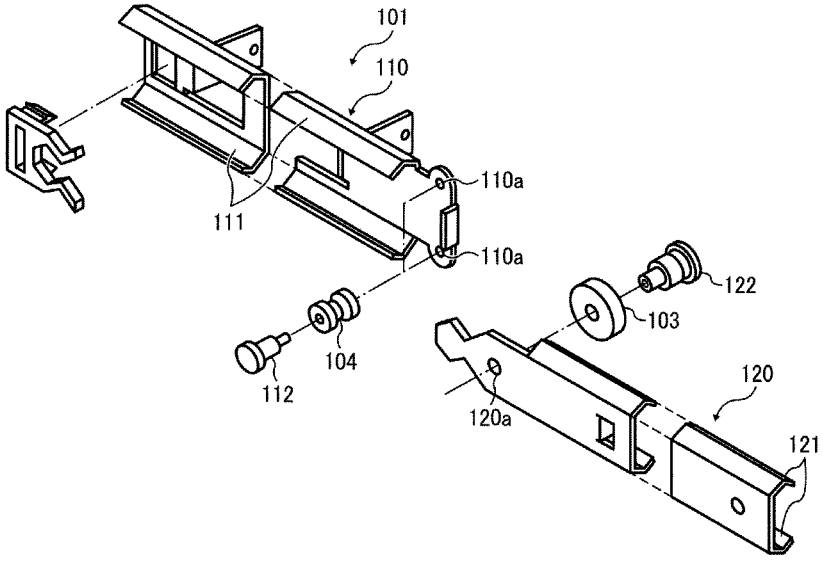
FIG. 14 PRIOR ART
FIG. 14 is an exploded oblique view of a conventional slide rail.

As illustrated in FIG. 13B, the second engaging member 26 includes a pair of arm members 26A, and a joint member 26B to connect the pair of arm members 26B, three members of which are integrally formed. The pair of arm members 26A is configured to extend in a direction separating from each other and is recovered in a direction to approach each other. The second engaging member 26 is disposed at a position next to the second roller 22 in the pushing-in direction and is fixed to one side surface of the second plate 23.

The second engaged member 35 is disposed at a position further extending from the third extending part 33A of the third plate 33 toward the pushing-in direction. Specifically, the second engaged member 35 is disposed in the pushing-in side more in the back than the fourth roller 32. The second engaged member 35 has a tapered, wavy shape.

When the intermediate rail 21 is pushed in the distal end direction, the first engaged member 25 expands the arm portions 18A of the first engaging member 18 to be separated from each other and is pushed in between the arm portions 18A, so that the first engaging member 18 holds the first engaged member 25. Thus, the intermediate rail 21 mounted inside the fixed rail 11 can be detachably retained. In addition, by changing the position of the first engaging member 18 disposed on the fixed rail 11, an insert amount of the intermediate rail 21 into the fixed rail 11 can be controlled.

When the movable rail 31 is pushed in the mounting side, the second engaged member 35 expands arm portions 26A of the second engaging member 26 to be separated from each other and is pushed in between the arm portions 26A, so that the second engaging member 26 holds the second engaged member 35. Thus, the movable rail 31 mounted in the intermediate rail 21 can be detachably retained. In addition, by changing the position of the second engaging member 26 disposed on the intermediate rail 21, an insert amount of the movable rail 31 into the movable rail 31 can be controlled.

The slide rail 1C according to the fourth embodiment includes the first engaging member 18, the first engaged member 25, the second engaging member 26, and the second engaged member 35, but the present invention is not limited to the above embodiment and can be configured such that either the first engaging member 18 with the first engaged member 25 and the second engaging member 26 with the second engaged member 35, may be omitted.

Further, in the above embodiments, each bent portion 14, 24, or 34 is formed to have an L-shaped cross-section, but may have a C-shaped cross-section or a V-shaped cross-section. The cross-section of each bent portion 14, 24, or 34 may only have a shape slidable on the rollers 12, 22, 20, 32, and 17.

In addition, in the above embodiments, each roller 12, 22, 20, 32, or 17 is slidably mounted on each rail 11, 21, or 31, but may be mounted to the rail so as not to be slidable relative to the rail as long as the friction coefficient between each roller and rail can be reduced to reasonably low. Further, the shape of the rollers 12, 22, 20, 32, and 17 may be other than the cylinder.

Additional modifications and variations of the present invention are possible in light of the above teachings. It is therefore to be understood that, within the scope of the appended claims, the invention may be practiced other than as specifically described herein.

What is claimed is:

1. A slide rail comprising:

a fixed rail including a rectangular-shaped first plate and a pair of first bent parts, each of the pair of first bent parts having one end being continuous with both ends in the width direction of the first plate, the each of the pair of first bent parts being bent in the depth direction of the first plate so that the other ends approach each other;

an intermediate rail including a rectangular-shaped second plate opposed to the first plate and a pair of second bent parts which is continuous with both ends in the width direction of the second plate at one end thereof and is bent in one direction so that the other ends approach each other, the intermediate rail disposed inside the fixed rail and slidable relative to the fixed rail reciprocally along a longitudinal direction of the first plate, and the second bent parts bending in a same direction as that of the first bent parts;

a movable rail including a rectangular-shaped third plate opposed to the second plate and a pair of third bent parts which is continuous with both ends in the width direction of the third plate at one end thereof and is bent in a direction so that the other ends thereof approach each other, the movable rail disposed inside the intermediate rail and slidable relative to the intermediate rail reciprocally along a longitudinal direction of the second plate both in the pulling-out and the pushing-in directions, and the third bent parts bending in a direction opposite that of the first bent parts;

a first roller mounted to the fixed rail at a proximal end in the pulling-out direction thereof and slidable on an outer below surface of the pair of second bent parts;

a second roller mounted to the intermediate rail at a distal end in the pushing-in direction thereof and slidable on an inner surface of the pair of first bent parts;

a third roller mounted to the intermediate rail at a proximal end in the pulling-out direction thereof and slidable on an inner surface of the pair of third bent parts; and a fourth roller mounted to the movable rail at a distal end in the pushing-in direction thereof and slidable on an inner surface of the pair of second bent parts.

2. A slide rail as claimed in claim 1, further comprising a pair of fifth rollers, mounted on the fixed rail closer to the proximal end than the second roller and closer to the distal end than the first roller, wherein the pair of fifth rollers sandwiches the pair of second bent parts and is mounted so as to slidably contact the pair of second bent parts of the intermediate rail.

3. A slide rail as claimed in claim 1, wherein:

the first plate of the fixed rail includes a first through-hole;

the first roller includes a cylindrical roller main part having a hole in its center thereof, and is mounted to the fixed rail by a rod passing through the first through-hole and the hole of the first roller in a state in which the first through-hole and the hole are aligned; and the first through-hole is disposed in a pair at both edges in the width direction of the first plate.

4. A slide rail as claimed in claim 1, further comprising a first engaging member disposed on the fixed rail and a first engaged member disposed on the intermediate rail, wherein the first engaged member extends from the second plate toward the distal end, disposed at a distal end of the second roller, and detachably engaged by the first engaging member.

5. A slide rail as claimed in claim 1, wherein:

the intermediate rail is provided with a second engaging member closer to the proximal side than the second roller; and the movable rail is provided with a second engaged member that extends from the third plate toward the distal end, is positioned closer to the distal end than the fourth roller, and is detachably engaged by the second engaging member.

6. A sheet feed device comprising:

a removable paper tray to contain a plurality of sheets therein; and a pair of slide rails as claimed in claim 1, disposed on both lateral walls of the paper tray so as to guide insertion and removal of the paper tray.

7. An image forming apparatus comprising a slide rail as claimed in claim 6.

* * * * *